US011673247B2

(12) United States Patent
Lu et al.

(10) Patent No.: US 11,673,247 B2
(45) Date of Patent: Jun. 13, 2023

(54) IMPACT DRILL

(71) Applicant: Nanjing Chervon Industry Co., Ltd., Nanjing (CN)

(72) Inventors: Wei Lu, Nanjing (CN); Fukinuki Masatoshi, Nanjing (CN); Yasheng Chen, Nanjing (CN)

(73) Assignee: Nanjing Chervon Industry Co., Ltd., Nanjing (CN)

( * ) Notice: Subject to any disclaimer, the term of this patent is extended or adjusted under 35 U.S.C. 154(b) by 155 days.

(21) Appl. No.: 17/061,618

(22) Filed: Oct. 2, 2020

(65) Prior Publication Data

US 2021/0107128 A1 Apr. 15, 2021

(30) Foreign Application Priority Data

Oct. 14, 2019 (CN) ..... 201910971339.9
Dec. 10, 2019 (CN) ..... 201911257898.X

(51) Int. Cl.
*B25D 17/24* (2006.01)
*B25B 21/02* (2006.01)

(52) U.S. Cl.
CPC ..... *B25D 17/24* (2013.01); *B25B 21/026* (2013.01); *B25D 2211/064* (2013.01); *B25D 2211/067* (2013.01)

(58) Field of Classification Search
CPC ..... B25D 17/24; B25D 2211/064; B25D 16/006; B25D 2211/067; B25B 21/004; B25B 21/026; B25B 21/023
See application file for complete search history.

(56) References Cited

U.S. PATENT DOCUMENTS 2,223,727 A * 12/1940 Homen ..... B25D 11/106 173/202
2,484,471 A * 10/1949 Shinn ..... B25D 11/106 74/56
3,433,082 A * 3/1969 Atkinson ..... B25D 16/00 408/124
3,511,321 A 5/1970 Schnettler
3,693,728 A 9/1972 Stroezel
3,736,992 A * 6/1973 Zander ..... B25D 16/00 173/104

(Continued)

FOREIGN PATENT DOCUMENTS

NL 54674 C 6/1943

*Primary Examiner* — Robert F Long
*Assistant Examiner* — Eduardo R Ferrero
(74) *Attorney, Agent, or Firm* — Greenberg Traurig, LLP

(57) ABSTRACT

An impact drill includes an output shaft capable of rotating around a first axis and moving along the first axis, a housing, a first impact block fixedly connected to the output shaft, a second impact block, a stopping element for stopping the output shaft from moving backward, and a movable element mounted on the housing. The housing is formed with a through hole for accommodating the movable element. The through hole passes through the housing in a first line and the movable element is capable of moving to a first position and a second position along the first line. When the movable element moves to the first position, the movable element prevents the output shaft from moving backward. When the movable element moves to the second position, the movable element allows the output shaft to move backward.

20 Claims, 20 Drawing Sheets

(56) References Cited

U.S. PATENT DOCUMENTS 3,789,933 A * 2/1974 Jarecki ..... B25D 11/106 173/202
3,799,275 A * 3/1974 Plattenhardt ..... B25D 16/00 173/48
3,809,168 A * 5/1974 Fromm ..... B25D 11/106 173/13
3,845,826 A * 11/1974 Beisch ..... B25D 16/006 173/205
3,867,988 A * 2/1975 Koehler ..... B25D 11/06 173/110
3,998,278 A * 12/1976 Stiltz ..... B25D 16/00 173/13
4,158,970 A * 6/1979 Laughon ..... B23B 45/008 81/475
4,159,050 A * 6/1979 Hopkins, Sr. ..... F16D 43/02 192/114 R
4,229,981 A * 10/1980 Macky ..... B25D 16/003 74/56
5,025,903 A * 6/1991 Elligson ..... B25F 5/001 81/475
5,282,510 A * 2/1994 Pacher ..... B25D 16/006 173/48
5,375,665 A * 12/1994 Fanchang ..... B25D 11/106 173/48
5,458,206 A * 10/1995 Bourner ..... B25B 23/1405 173/104
5,505,271 A * 4/1996 Bourner ..... B25D 16/006 173/205
5,628,374 A * 5/1997 Dibbern, Jr. ..... B25D 16/00 173/217
5,992,257 A * 11/1999 Nemetz ..... B23B 45/008 464/84
6,142,242 A * 11/2000 Okumura ..... B25D 16/00 173/48
6,152,242 A * 11/2000 Chung ..... B25D 16/00 173/48
6,213,222 B1 * 4/2001 Banach ..... B25D 16/00 173/205
6,688,406 B1 * 2/2004 Wu ..... B25D 16/00 173/48
7,762,349 B2 * 7/2010 Trautner ..... B25D 16/006 173/104
7,854,274 B2 * 12/2010 Trautner ..... B25D 16/006 173/90
11,260,516 B1 * 3/2022 Roberts ..... B25F 5/001
2004/0050568 A1 * 3/2004 Orozco, Jr. ..... B25D 11/102 173/100
2005/0028996 A1 * 2/2005 Toukairin ..... B25D 17/24 173/176
2006/0213675 A1 * 9/2006 Whitmire ..... B25F 5/001 173/48
2006/0231277 A1 * 10/2006 Puzio ..... B25D 17/00 173/48
2006/0237205 A1 * 10/2006 Sia ..... B25B 23/1405 173/128
2007/0007024 A1 * 1/2007 Tokairin ..... B25D 17/24 173/48
2007/0068693 A1 * 3/2007 Whitmire ..... B23B 45/008 173/217
2007/0137875 A1 * 6/2007 Spielmann ..... B25B 21/023 173/216
2008/0223592 A1 * 9/2008 Erhardt ..... B25D 16/006 173/48
2009/0126958 A1 * 5/2009 Trautner ..... B25D 16/006 173/104
2010/0326687 A1 * 12/2010 Roehm ..... B25D 16/006 173/48
2012/0018181 A1 * 1/2012 Chen ..... B25F 5/001 173/47
2012/0175140 A1 * 7/2012 Hecht ..... B25D 11/062 173/48
2014/0110140 A1 * 4/2014 Elger ..... B25D 11/106 173/48
2014/0144657 A1 * 5/2014 Tseng ..... B25D 11/106 173/48
2014/0338940 A1 * 11/2014 Kelleher ..... B25D 17/20 173/48
2018/0318998 A1 11/2018 Duncan et al.
2019/0299383 A1 * 10/2019 Dedrickson ..... B25D 16/006
2021/0138624 A1 * 5/2021 Kamiya ..... B25F 5/001

* cited by examiner

IMPACT DRILL

RELATED APPLICATION INFORMATION

This application claims the benefit under 35 U.S.C. § 119(a) of Chinese Patent Application No. CN 201910971339.9, filed on Oct. 14, 2019, and Chinese Patent Application No. CN 201911257898.X, filed on Dec. 10, 2019, which applications are incorporated herein by reference in their entirety.

TECHNICAL FIELD

The present disclosure relates to a power tool, and in particular to an impact drill.

BACKGROUND

An impact drill is a kind of drilling tool. Due to its functional requirements, there are generally two modes for operating the impact drill: a drilling mode and an impact mode. When the impact drill is in the drilling mode, the main shaft of the impact drill only outputs torque. When the impact drill is in the impact mode, the main shaft has a reciprocating motion along its axial direction while outputting torque, thereby realizing the impact function. In the existing impact drill, to realize the conversion of two modes, a conversion structure is generally required. The conversion structure is relatively complicated, and the conversion structure is distributed inside and outside the housing of the impact drill, which may lead to oil leakage.

SUMMARY

In one example of the disclosure, an impact drill includes an output shaft capable of rotating around a first axis and moving along the first axis; a housing comprising an accommodating portion for accommodating at least part of the output shaft; a first impact block fixedly connected to the output shaft; a second impact block arranged in the housing; an elastic member configured to have an elastic force that makes the first impact block and the second impact block separate from each other; a stopping element for stopping the output shaft from moving backward along the first axis; and a movable element mounted on the housing; wherein the housing is formed with a through hole for accommodating at least part of the movable element, the through hole passes through the housing in a first line, and the movable element is capable of moving to a first position and a second position along the first line; wherein when the movable element moves to the first position along the first line, the movable element abuts against a rear end of the stopping element to prevent the output shaft from moving backward; and wherein when the movable element moves to the second position along the first line, the movable element disengages with the stopping element to allow the output shaft to move backward.

In one example, the first line is perpendicular to the first axis.

In one example, the first line is a radial direction perpendicular to the first axis.

In one example, the movable element includes a main body disposed in the through hole, and the main body extends along the first line.

In one example, the main body is a cylinder, the through hole is a cylindrical hole, and the diameter of the cylinder is substantially equal to the diameter of the cylindrical hole.

In one example, the movable element further includes a head portion arranged at one end of the main body, the head portion is disposed outside the accommodating portion, and the main body can be inserted into an inner side of the accommodating portion along the first line.

In one example, the moving element is a pin extending along the first line.

In one example, an area of a cross-section of the movable portion in a plane perpendicular to the first line is substantially equal to an area of a cross-section of the through hole in the plane, i.e., is within accepted manufacturing tolerances while remaining sized to operate as intended.

In one example, the impact drill further includes a switching assembly for driving the movable portion to move from the second position to the first position.

In one example, the switching assembly is located outside the accommodating portion.

In one example, the through hole is provided on the accommodating portion.

In one example, the impact drill further includes a spring sleeved on the movable portion that reserves an elastic force for pushing the movable portion to the second position.

In one example, the impact drill further includes a limiting element fixedly arranged in the housing, and the limiting element is used to limit the rotation of the stopping element.

In one example, the stopping element further includes a protrusion for matching with the movable portion, and the stopping element is provided with a sliding groove for the protrusion to be positioned therein, and the protrusion can slide along the sliding groove.

In one example, the stopping element is arranged in the accommodating portion.

In one example, the first impact block is provided with a first tooth surface, and the second impact block faces the first impact block and is provided with a second tooth surface for matching with the first tooth surface.

In another example of the disclosure, an impact drill includes a housing; an output shaft capable of rotating around a first axis and moving along the first axis; a first impact block fixedly connected to the output shaft; a second impact block arranged in the housing; an elastic member configured to have an elastic force that makes the first impact block and the second impact block separate from each other; and a movable element mounted on the housing; wherein the housing is formed with a through hole for accommodating at least part of the movable element, the through hole passes through the housing in a first line, and the movable element is capable of moving to a first position and a second position along the first line; wherein when the movable element moves to the first position along the first line, the movable element prevents the output shaft from moving backward; and wherein when the movable element moves to the second position along the first line, the movable element allows the output shaft to move backward.

In one example, the first line is perpendicular to the first axis.

In one example, the first line is a radial direction perpendicular to the first axis.

In one example, the movable element includes a main body extending along the first line.

DETAILED DESCRIPTION

Figure 1:
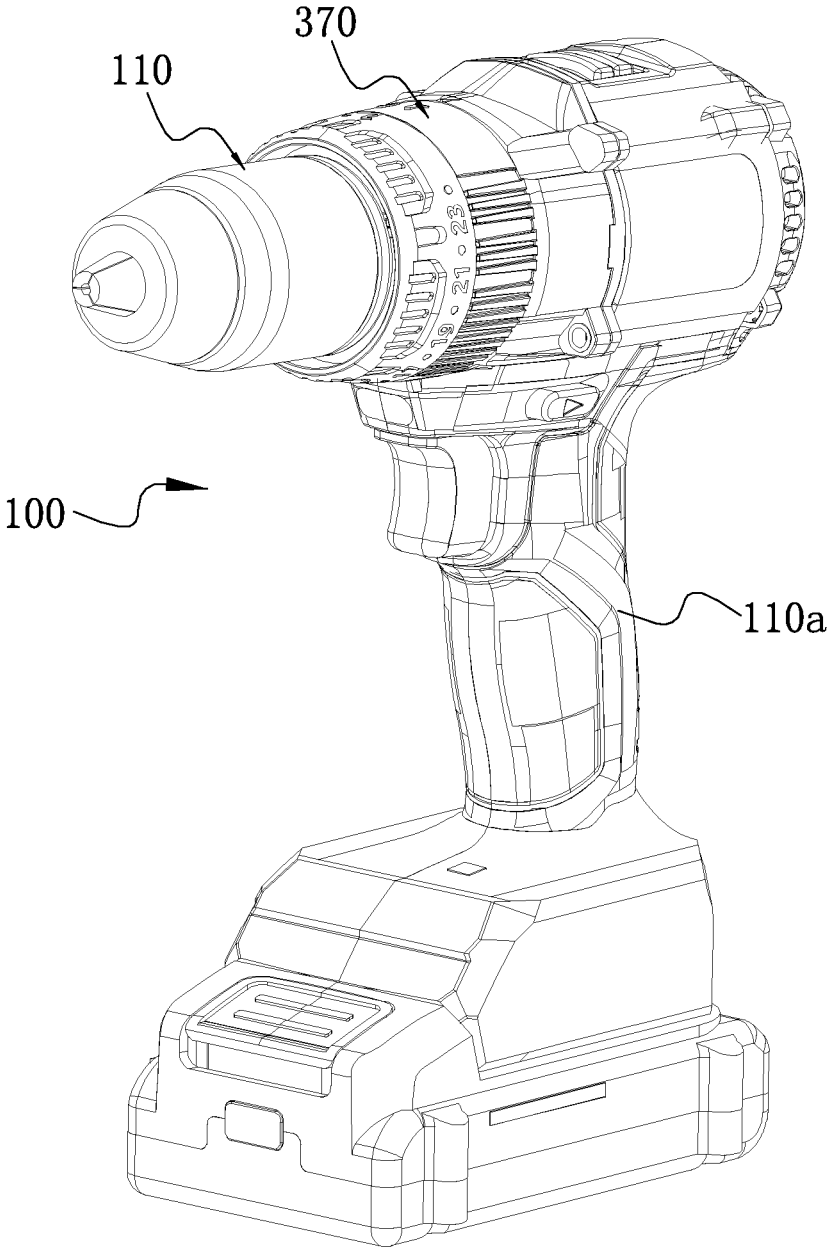
FIG. 1 is a perspective view of an impact drill according to a first example.
Figure 2:
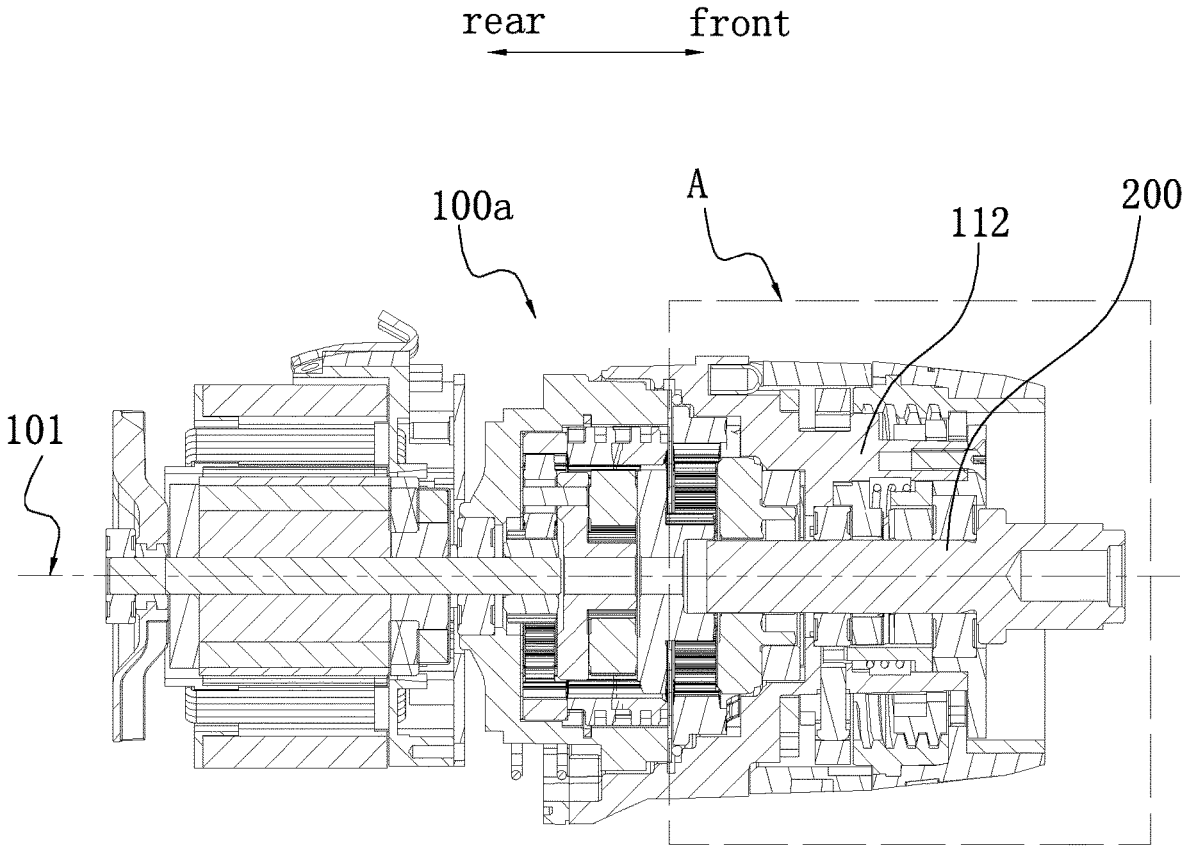
FIG. 2 is a cross-sectional view of a part of the impact drill of FIG. 1.
Figure 3:
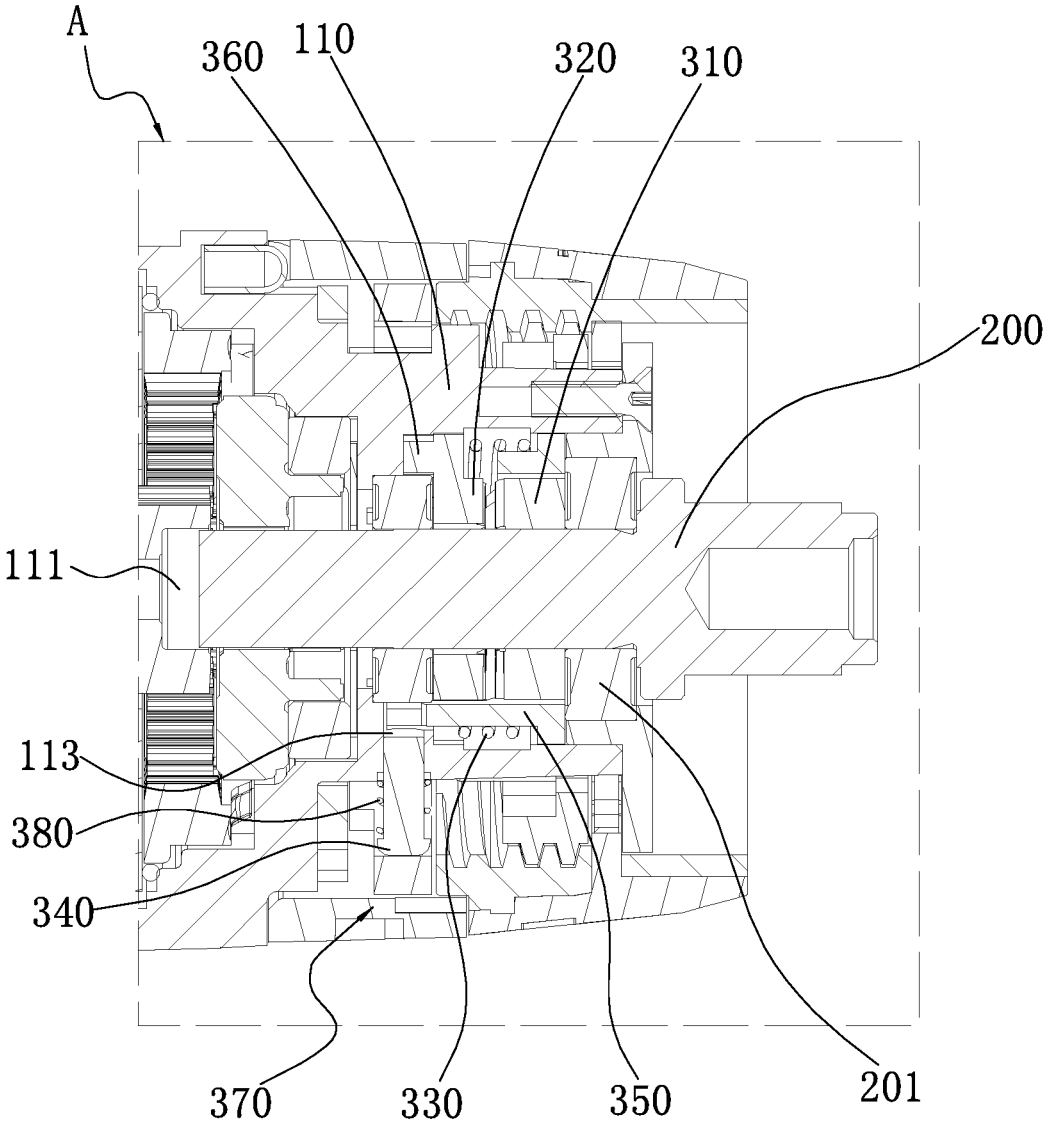
FIG. 3 is an enlarged view of area A of FIG. 2.

FIG. 1 shows an electric power tool capable of outputting torque. The electric power tool is an impact drill 100 in a first example. As shown in FIGS. 1 and 2, the impact drill 100 includes a housing 110, a transmission mechanism 500, and an output shaft 200 arranged in the housing 110, and the transmission mechanism 500 includes a motor 400 for outputting power. The output shaft 200 can rotate around a first axis 101. The output shaft 200 has a degree of freedom to move in a direction parallel to the first axis 101 of the output shaft 200 in the housing 110. That is to say, the output shaft 200 can move along the first axis 101. The housing 110 also includes a handle 110*a* for a user to hold, and one end of the handle 110*a* is connected with a battery pack. As shown in FIG. 3, the housing 110 has an accommodating space for accommodating the output shaft 200, and there is a gap 111 disposed at a rear end of the output shaft 200 so that the output shaft 200 can move backward along the first axis 101. The output shaft 200 can rotate and reciprocate under the drive of the transmission mechanism 500, so that the impact drill 100 has a drilling mode and an impact mode.

Referring to FIGS. 3-6, the impact drill 100 further includes a first impact block 310 and a second impact block 320 disposed oppositely, and the first impact block 310 is fixedly connected to the output shaft 200. That is to say, the first impact block 310 can rotate together with the output shaft 200. A first tooth surface 311 is provided on one side of the first impact block 310.

Figure 6:
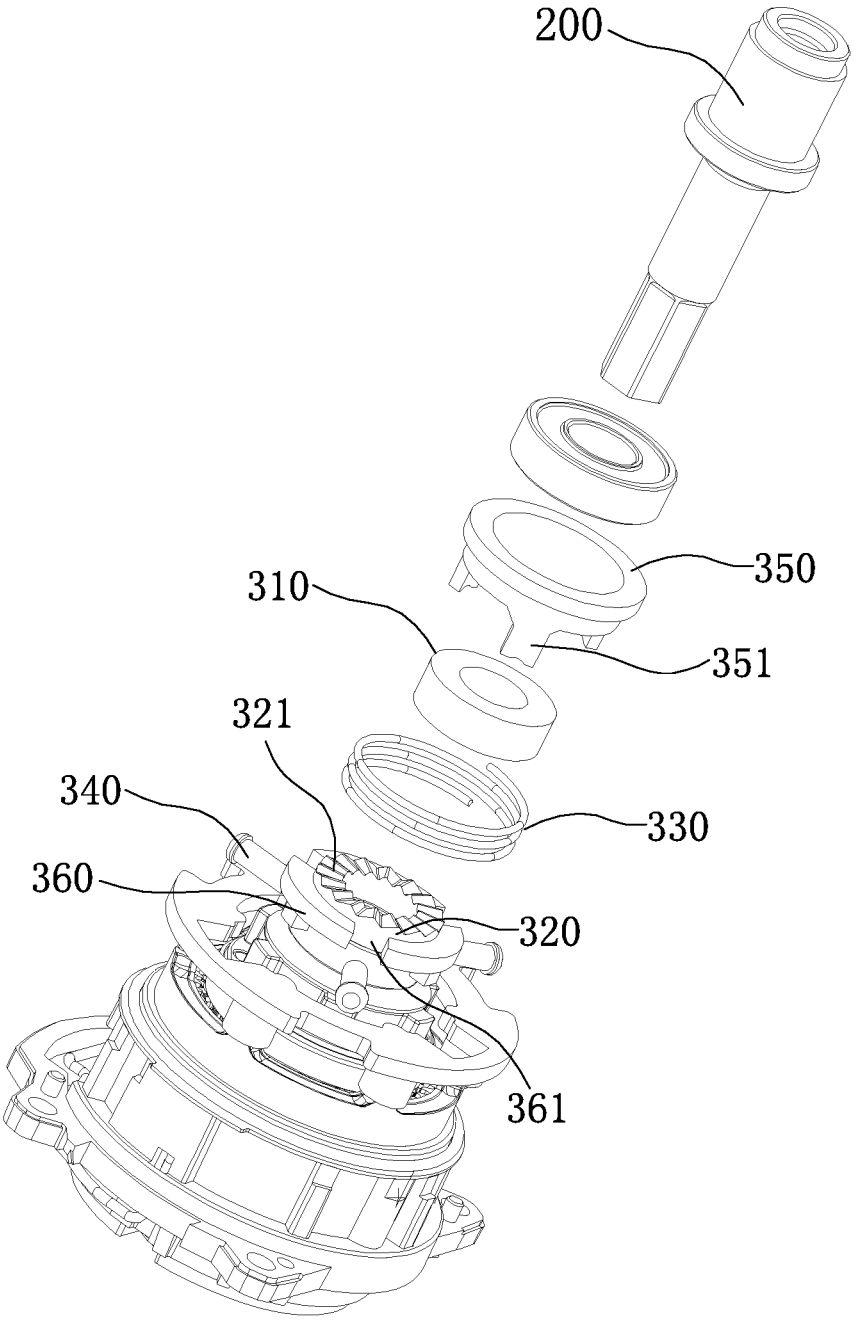
FIG. 6 is a view of the structure shown in FIG. 5 from another angle.

As shown in FIGS. 3 and 6, the second impact block 320 is disposed in the housing 110, and a second tooth surface 321 is disposed on one side of the second impact block 320 opposite to the first impact block 310. Referring to FIG. 3, when the first impact block 310 and the second impact block 320 are close to each other and in contact with each other, as the first impact block 310 rotates, the first impact block 310 and the second impact block 320 will continue to approach or move away, the second impact block 320 generates a reciprocating force to push the output shaft 200 to reciprocate along its axial direction to realize an impact function, so that the impact drill 100 is in the impact mode. When the impact function is not required, it is only necessary to separate the first impact block 310 and the second impact block 320 and restrict the output shaft 200 from being able to move axially. At this time, the impact drill 100 is in the drilling mode.

As shown in FIG. 3, the impact drill 100 further includes an elastic member 330. The elastic member 330 has a predetermined elastic force between the first impact block 310 and the second impact block 320, and the elastic force can make the first impact block 310 and the second impact block 320 have a tendency to separate from each other, so that the first impact block 310 and the second impact block 320 are separated from each other when the impact drill 100 is not working. When the impact drill 100 is working, the output shaft 200 is driven by the motor 400 of the impact drill 100 to rotate. At the same time, the user will push the output shaft 200 against a wall or a surface of a workpiece during operation. The force applied by the user can overcome the elastic force between the first impact block 310 and the second impact block 320, so that the first impact block 310 and the second impact block 320 are engaged to realize the impact function. If the impact function is not required, a function switching can be realized by limiting the output shaft 200 not to move axially.

Figure 4:
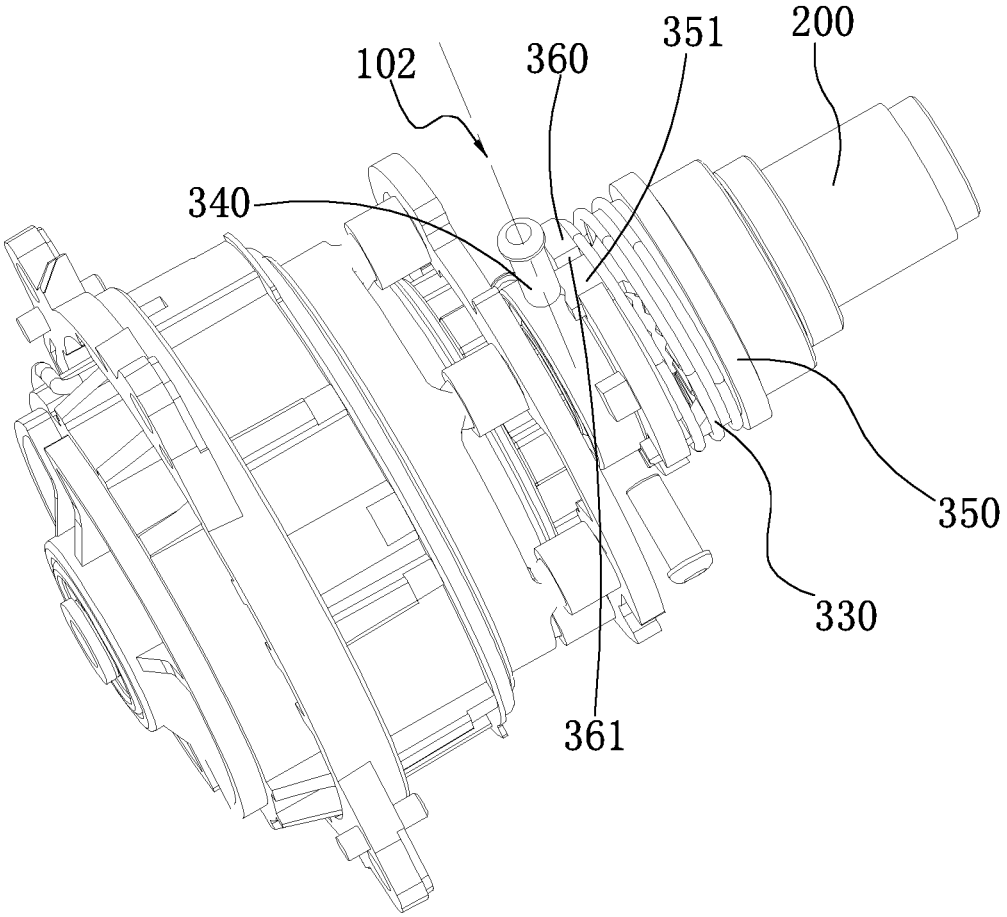
FIG. 4 is a perspective view of a transmission mechanism of the impact drill of FIG. 1.
Figure 5:
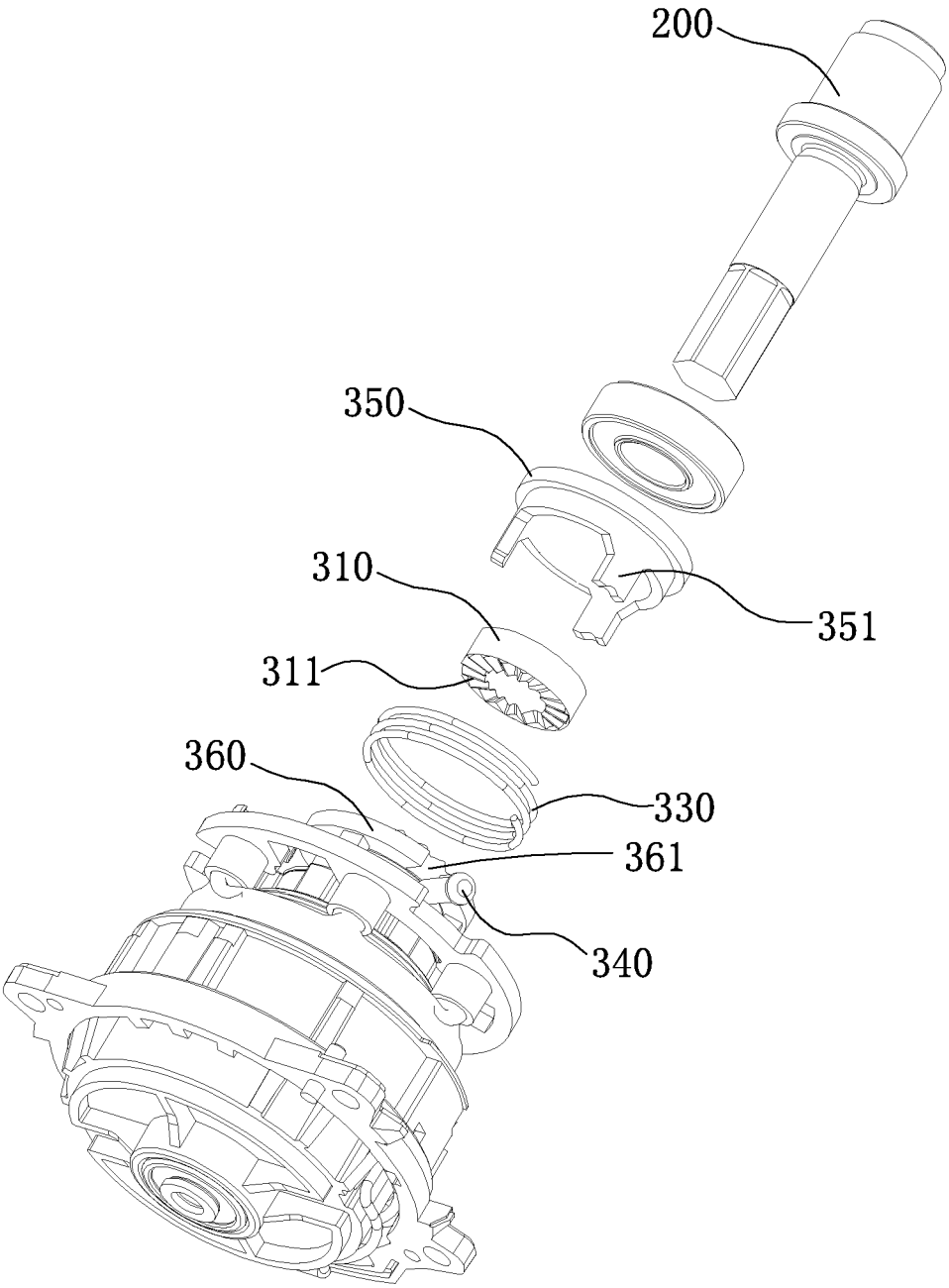
FIG. 5 is an exploded view of the structure shown in FIG. 4.

As shown in FIGS. 3 and 4, the impact drill 100 further includes a movable element 340, and the movable element 340 can move to a first position and a second position along a first line 102. When the movable element 340 moves to the first position, the movable element 340 limits the output shaft 200 from moving along the first axis 101. When the movable element 340 moves to the second position, the movable element 340 allows the output shaft 200 to move along the first axis 101. A stopping element 350 is sleeved on the output shaft 200, and a front end of the stopping element 350 abuts on a bearing 201 connected to the output shaft 200. The stopping element 350 stops the output shaft 200 from moving backward along the first axis 101 when the position of the stopping element 350 in a front and rear direction is fixed. The housing 110 includes an accommodating portion 112 for accommodating a portion of the output shaft 200, and the first impact block 310 and the second impact block 320 are both disposed in the accommodating portion 112. The movable element 340 is mounted on the accommodating portion 112 of the housing 110. The accommodating portion 112 of the housing 110 is provided with a through hole 113 for accommodating at least part of the movable element 340. The through hole 113 passes through the housing 110 along the first line 102. The movable element 340 is disposed in the through hole 113 and penetrates from the outside to the inside of the accommodating portion 112 of the housing 110. When the movable element 340 is pressed down, the movable element 340 moves to the first position along the first line 102, and the movable element 340 abuts against a rear end of the stopping element 350. At this time, the stopping element 350 cannot move backward along the first axis 101, which also limits the output shaft 200 and the bearing 201 from moving backward in the first axis 101, so that the output shaft 200 is positioned in the first axis 101 and cannot produce axial movement. The first impact block 310 installed on the output shaft 200 cannot move backward to a position in contact with the second impact block 320, so the output shaft 200 can only output torque. At this time, the impact drill 100 is in the drilling mode. When the movable element 340 is pulled up, the movable element 340 moves to the second position along the first line 102, the movable element 340 disengages from the stopping element 350, the restriction on the axial movement of the output shaft 200 is cancelled, and the output shaft 200 can move in the first axis 101. At this time, under the engagement of the first impact block 310 and the second impact block 320, the output shaft 200 outputs torque and impact force, so that the impact drill 100 is switched to the impact mode.

In the present example, the structure of the impact drill 100 for switching between the drilling mode and the impact mode is relatively simple. The accommodating portion 112 of the housing 110 accommodates the part of the output shaft 200, and the stopping element 350, the first impact block 310 and the second impact block 320 are arranged in the accommodating portion 112. Grease for lubricating the transmission mechanism 500 is provided in the accommodating portion 112 of the housing 110. Only the movable element 340 passes through the inside and outside of the housing 110, and the movable element 340 is always inserted into the through hole 113 regardless of whether it is pulled up or pressed down, preventing grease leakage of the housing 110. However, in the prior art, a conversion structure for switching between a drilling mode and a impact mode is complicated, and there are many parts passing through the inside and outside of a housing, which is very easy to cause grease leakage, holes formed on the housing cannot always be blocked, and grease leakage is very easy to occur. Since the housing 110 is only provided with the through hole 113 through which the movable element 340 can pass, the structural strength of the housing 110 is higher, so that it can cope with more complicated working conditions, and the service life of the impact drill 100 is longer.

In the present example, the first line 102 is perpendicular to the first axis 101. Furthermore, the first line 102 is a radial direction perpendicular to the first axis 101. That is to say, the first line 102 is a radial direction of the first axis 101. The accommodating portion 112 surrounds the output shaft 200, the movable element 340 is a pin extending in the first line 102 perpendicular to the first axis 101, and the through hole 113 penetrates the accommodating portion 112 along the first line 102. The movable element 340 can move along the first line 102. When the movable element 340 is pressed down, the movable element 340 moves along the first line 102 towards the first axis 101. When the movable element 340 is pulled out, the movable element 340 is away from the first axis 101 along the first line 102. In this way, the movement path of the movable element 340 is consistent with the extending direction of the movable element 340, so that the grease inside the accommodating portion 112 can be prevented from flowing out of the through hole 113.

The impact drill 100 further includes a limiting element 360 for limiting the rotation of the stopping element 350. The limiting element 360 is provided in the housing 110, the limiting element 360 is provided with a sliding groove 361 extending along a direction parallel to the first axis 101, and the stopping element 350 is provided with a protrusion 351 that cooperates with the sliding groove 361. The protrusion 351 can be positioned in the sliding groove 361 and slide in the sliding groove 361, which can limit the stopping element 350. The stopping element 350 only moves along the first axis 101, and does not rotate around the output shaft 200, so as to avoid wear on the movable element 340.

The width of the protrusion 351 in a circumferential direction of the output shaft 200 is less than or equal to the width of the sliding groove 361 in the circumferential direction of the output shaft 200 so that the protrusion 351 can be received in the sliding groove 361 and can slide in the sliding groove 361.

Figure 7:
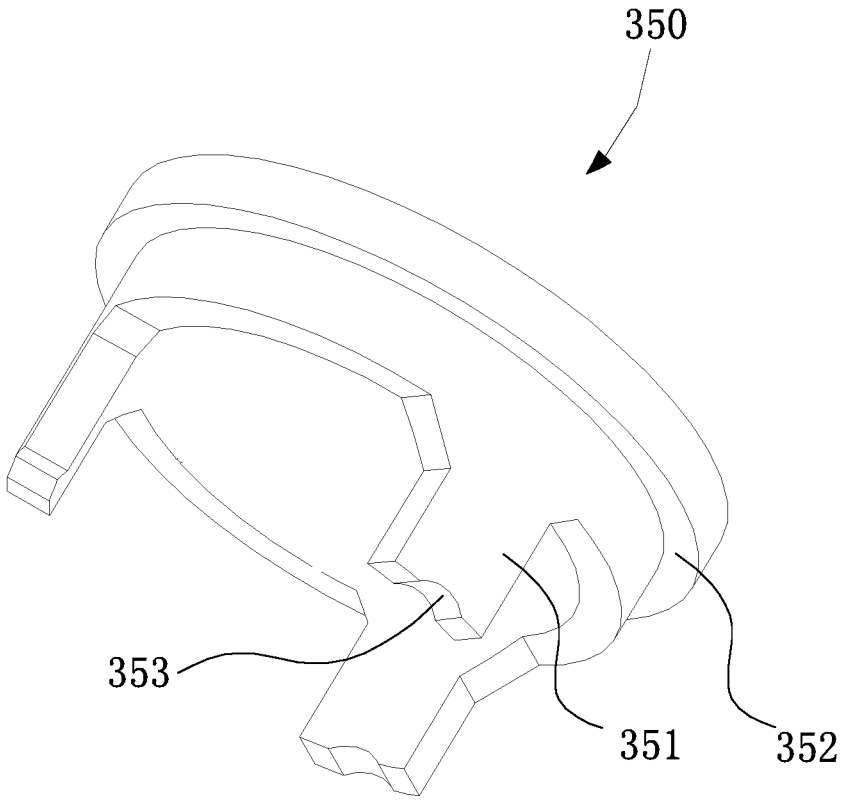
FIG. 7 is a perspective view of a stopping element of FIG. 6.

When the movable element 340 is pressed down, it abuts against an end of the protrusion 351. As shown in FIG. 7, the end of the protrusion 351 is provided with a notch 353 for matching with the movable element 340. When the movable element 340 is pressed down, it cooperates with the notch 353 to limit the axial movement of the stopping element 350, thereby limiting the axial movement of the output shaft 200, so that the impact drill 100 only outputs torque.

The notch 353 is arc-shaped, and its curvature is adapted to the curvature of the surface of the movable element 340, so that the notch 353 can be clamped on the movable element 340, so that the stopping element 350 is clamped on the movable element 340, avoiding the stopping element 350 sliding on the movable element 340 and improving the stability of the impact drill 100 in operation.

In the present example, as shown in FIGS. 3 and 4, the elastic member 330 for separating the first impact block 310 and the second impact block 320 from each other may be provided between the stopping element 350 and the limiting element 360. The first impact block 310 and the second impact block 320 are separated by elastic force. The limiting element 360 is fixedly arranged in the housing 110, and the front end of the stopping element 350 abuts on the output shaft 200. As long as the elastic member 330 is arranged between the stopping element 350 and the limiting element 360, it can be realized that the first impact block 310 and the second impact block 320 are separated. When in use, pressing the output shaft 200 against a surface to be drilled can overcome the elastic force of the elastic member 330 and make the first impact block 310 and the second impact block 320 engage.

The elastic member 330 is a first spring. One end of the first spring abuts against the stopping element 350 and the other end abuts against the limiting element 360.

The front end of the stopping element 350 is also provided with a limiting protrusion 352, and the limiting protrusion 352 is a circle of protrusion extending outward from the front end of the stopping element 350. The end of the elastic member 330 connected with the stopping element 350 can be pressed against the limiting protrusion 352 so that the elastic member 330 is positioned on the stopping element 350.

Figure 8:
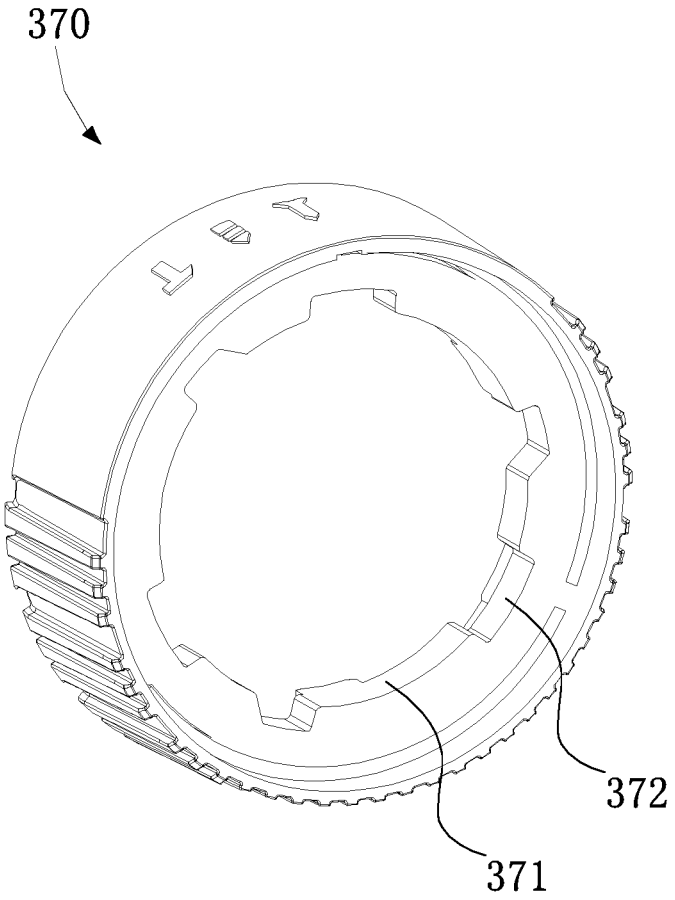
FIG. 8 is a perspective view of a switching assembly of FIG. 6.

As shown in FIGS. 1, 3 and 8, the impact drill 100 further includes a switching assembly 370, which is used to drive the movable element 340 to move from the second position to the first position. The switching assembly 370 is located outside the accommodating portion 112. The switching assembly 370 is sleeved on the surface of the housing 110 and cooperates with the movable element 340, and the switching assembly 370 can rotate around the housing 110. The inner wall of the switching assembly 370 is provided with protrusions 371 and grooves 372 at intervals along its circumferential direction. When the protrusions 371 are rotated to be opposite to the movable element 340, the protrusions 371 can abut against the movable element 340 to press down the movable element 340 to make the movable element 340 abut against the rear end of the stopping element 350, the output shaft 200 is axially limited. At this time, the output shaft 200 cannot move axially and can only output torque. When the grooves 372 rotates to be opposite to the movable element 340, the movable element 340 can be released, and the movable element 340 is away from the stopping element 350, and the output shaft 200 can move axially to output impact force and torque.

As shown in FIGS. 1 and 3, the impact drill 100 also includes a second spring 380, the second spring 380 is sleeved on the movable element 340, one end of the second spring 380 abuts against the surface of the housing 110, and the other end of the housing 110 abuts against the movable element 340. When the protrusions 371 of the switching assembly 370 are opposed to the movable element 340, the second spring 380 is compressed along the radial direction of the output shaft 200, so that the second spring 380 reserves an elastic force. When the grooves 372 of the switching assembly 370 are opposite to the movable element 340, the movable element 340 can be pushed out to the second position under the elastic force of the second spring 380.

Figure 9:
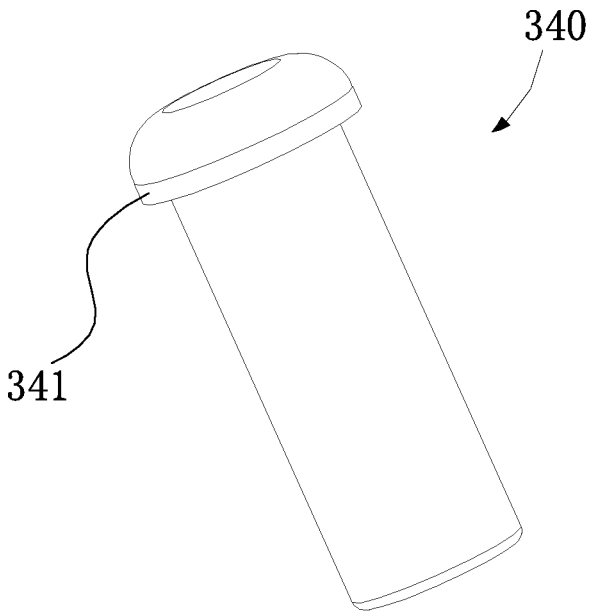
FIG. 9 is a perspective view of a movable element of FIG. 6.
Figure 10:
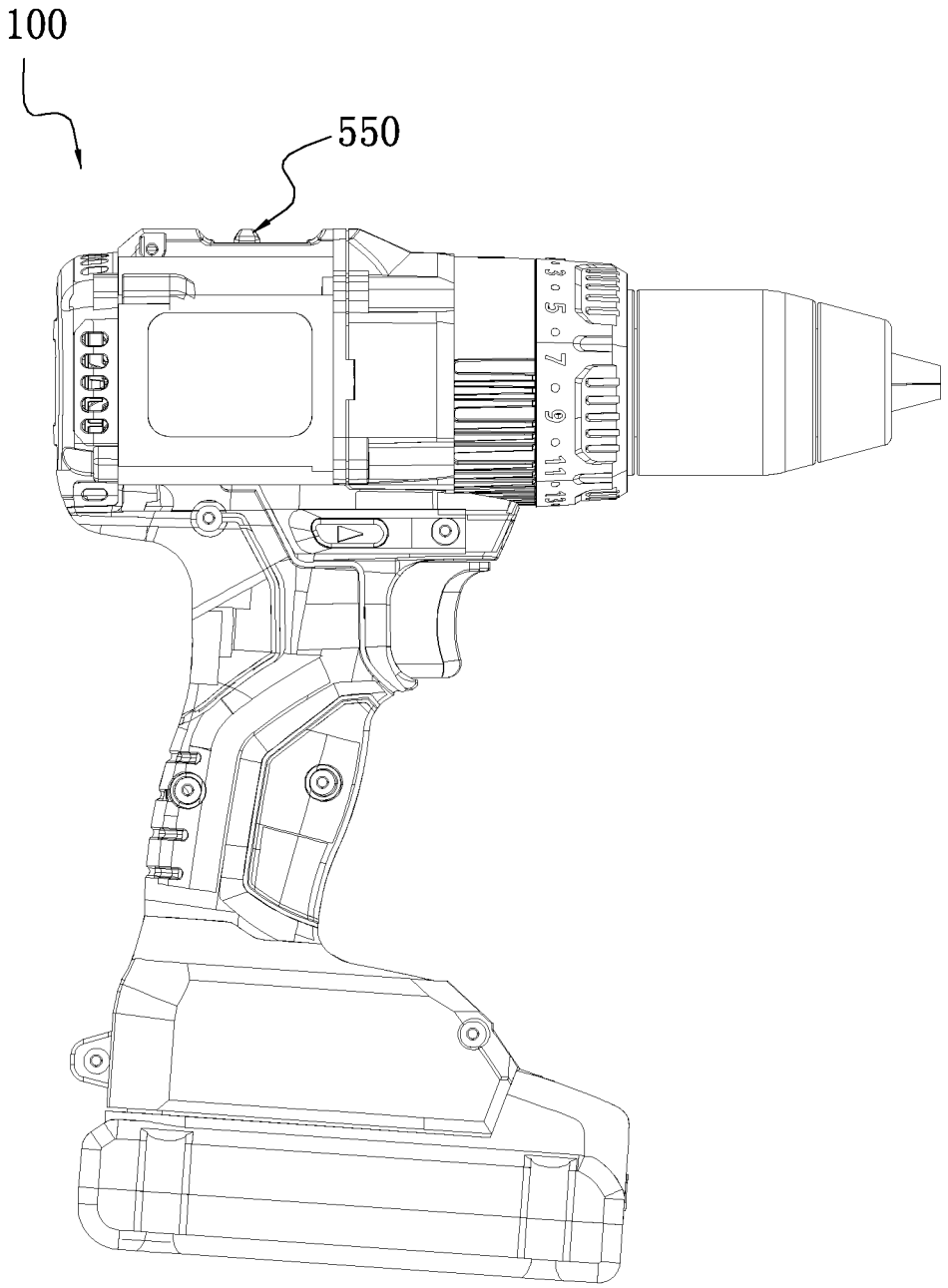
FIG. 10 is a plan view of the impact drill of FIG. 1.
Figure 11:
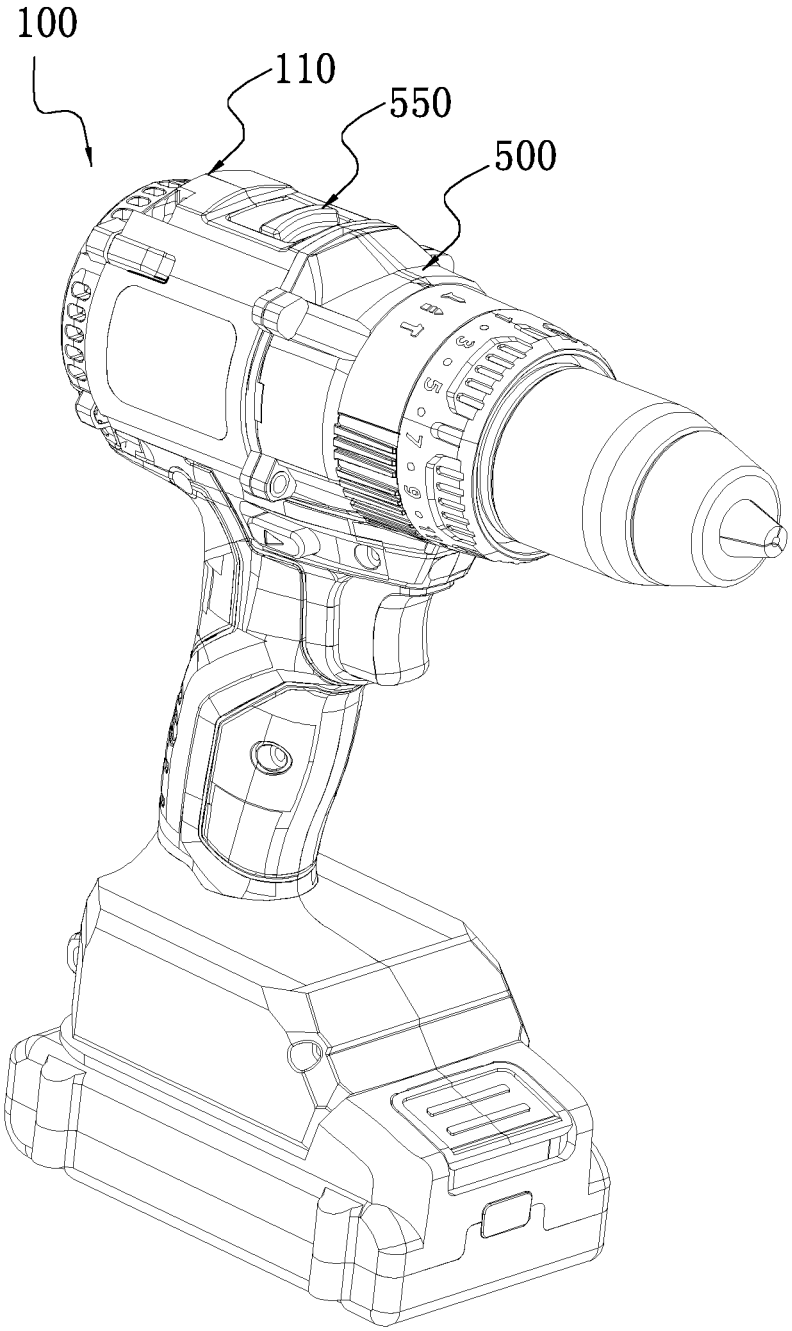
FIG. 11 is another perspective view of the impact drill of FIG. 10.
Figure 12:
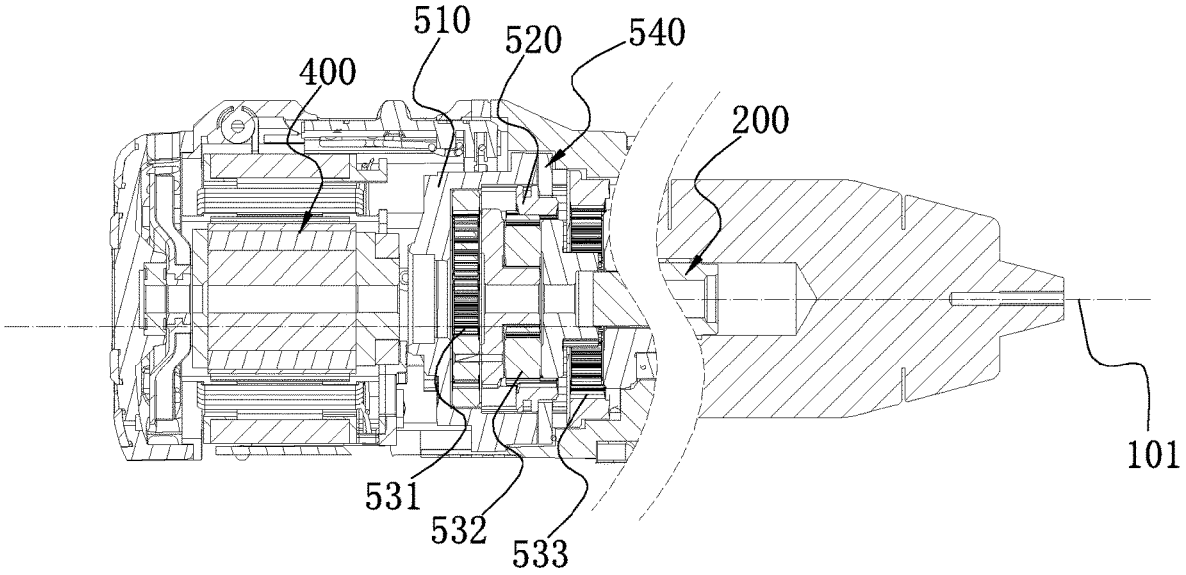
FIG. 12 is a cross-sectional view of the impact drill of FIG. 10 without a handle and a battery pack.
Figure 13:
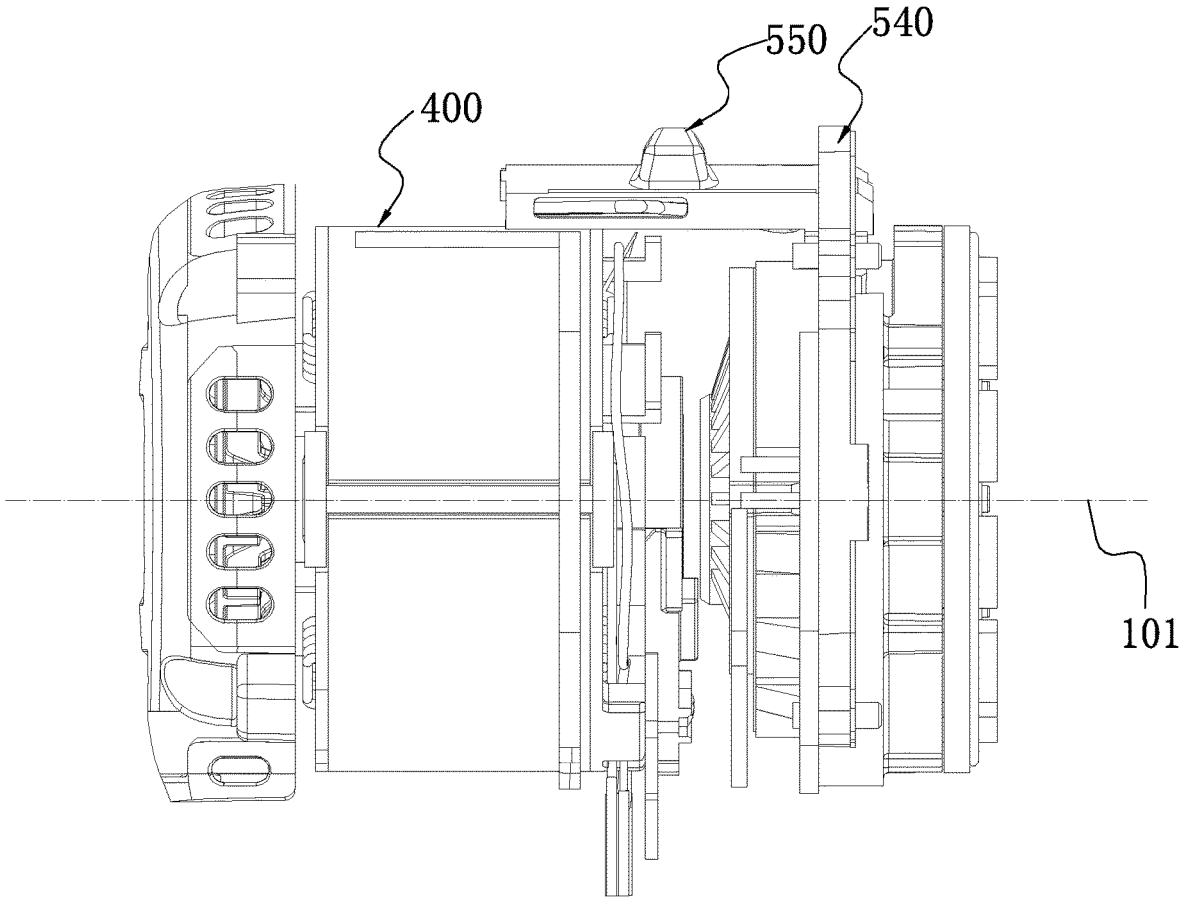
FIG. 13 is a plan view of a motor and a part of the transmission mechanism of the impact drill of FIG. 10.
Figure 14:
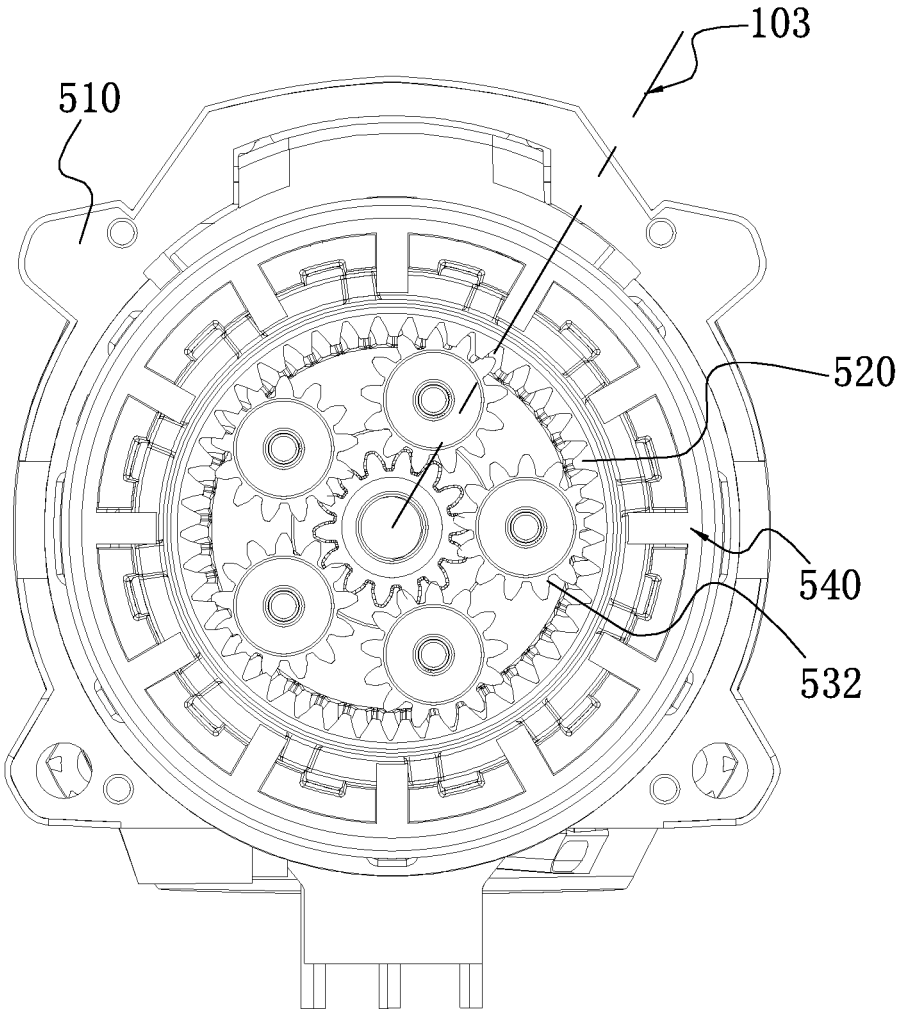
FIG. 14 is a plan view of the structure shown in FIG. 13 from another angle.
Figure 15:
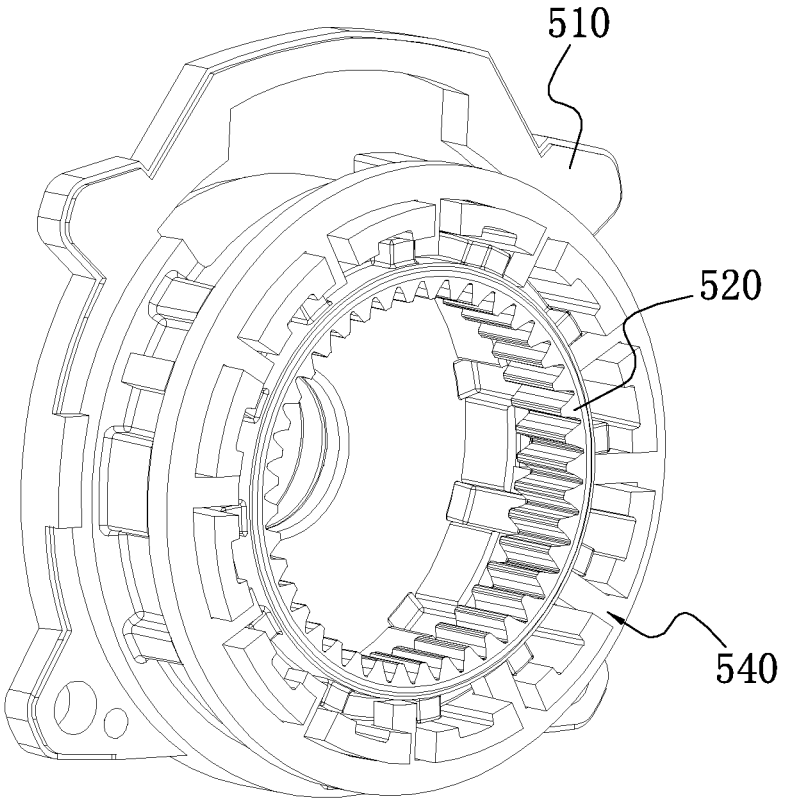
FIG. 15 is a perspective view of a transmission housing, a shifting element and a locking element of the impact drill of FIG. 10.

As shown in FIG. 9, the movable element 340 includes a main body 342 and a head portion 341, and the head portion 341 is disposed at one end of the main body 342. The head portion 341 is disposed outside the accommodating portion 112, and the main body 342 can be inserted into an inner side of the accommodating portion 112 along the first line 102. The main body 342 is disposed in the through hole 113, and the main body 342 extends along the first line 102. The main body 342 is a cylinder centered in the first line 102. The main body 342 passes through the through hole 113, and correspondingly, the through hole 113 is a cylindrical hole. The maximum outer diameter of the head portion 341 is greater than the maximum outer diameter of the main body 342. As shown in FIGS. 3 and 9, the second spring 380 abuts on the head portion 341, so that the movable element 340 can be pulled out from the housing 110 under the elastic force of the second spring 380.

The head portion 341 of the movable element 340 is a circular arc surface, which facilitates the inner wall of the switching assembly 370 to slide relative to the movable element 340, thereby smoothly switching the state of the movable element 340.

An arc transition surface is provided at a junction of the protrusions 371 and the grooves 372, so that the junction can smoothly slide over the movable element 340 to switch the protrusions 371 or the grooves 372 to be opposite to the movable element 340.

In the present example, as shown in FIG. 3, the diameter of the through hole 113 of the housing 20 for disposing the movable element 340 is greater than or equal to the diameter of the main body 342 of the movable element 340, so as to ensure that the movable element 340 slides in the through hole 113 smoothly. However, preferably, the diameter of the movable element 340 can be set to be equal to the diameter of the through hole 113, so that an area of a cross-section of the movable element 340 in a plane perpendicular to the first line 102 is equal to an area of cross-section of the through hole 113 in the plane. The movable element 340 can be closely matched with the through hole 113 to better avoid grease leakage.

In addition, as shown in FIG. 3, the second impact block 320 and the limiting element 360 can be formed as one piece. Because the second impact block 320 and the limiting element 360 are fixed on the housing 110, the second impact block 320 and the limiting element 360 can be integrally formed as one part, which reduces installation steps, improves the integration of parts, and reduces a number of the parts. However, due to different materials and molding methods, the second impact block 320 and the limiting element 360 can also be set as two separate parts.

In the present example, the electric power tool is the impact drill 100. The following specifically describes how the transmission mechanism 500 switches between different gears. It is understandable that the electric power tool with following structure that enables the transmission mechanism 500 to switch between different gears may also be other torque output tools. For example, in other examples, the electric power tool may also be a hand-held electric power tool such as an electric drill, an impact wrench, an electric hammer, an electric pick, a screwdriver, etc. As shown in FIGS. 10-13, the motor 400 includes a motor shaft that rotates around a second axis. In the present example, the second axis coincides with the first axis 101.

The transmission mechanism 500 connects the motor 400 and the output shaft 200 and transmits the power of the motor 400 to the output shaft 200. The transmission mechanism 500 includes a transmission housing 510, and an accommodating space for accommodating a transmission member is formed by the transmission housing 510. In the present example, a gear transmission is adopted, and the transmission member includes gears. The transmission mechanism 500 further includes a shifting element 520, and the shifting element 520 has at least a first axial position and a second axial position relative to the transmission housing 510. When the shifting element 520 is at the first axial position, the output shaft 200 has a first speed. When the shifting element 520 is at the second axial position, the output shaft 200 has a second speed. The first speed is less than the second speed. By adjusting the position of the shifting element 520 relative to the transmission housing 510, the impact drill 100 can be switched between different output speeds.

As shown in FIGS. 13-16, the impact drill 100 further includes a locking element 540 for locking and releasing the shifting element 520, the locking element 540 includes a locking portions 541 extending along a radial direction 103 of the first axis 101, and the transmission housing 510 is engaged with the locking portions 541 to fix the locking element 540 relative to the transmission housing 510 in a circumferential direction of the first axis 101. When the shifting element 520 is in the first axial position, the shifting element 520 is engaged with the locking portions 541 to fix the shifting element 520 relative to the locking element 540 in the circumferential direction of the first axis 101. In other words, when the shifting element 520 is at the first axial position relative to the transmission housing 510, the locking portions 541 of the locking element 540 is simultaneously engaged with the transmission housing 510 and the shifting element 520, so that the locking element 540 and the shifting element 520 are all fixed relative to the transmission housing 510 in the circumferential direction of the first axis 101. When the shifting element 520 is in the second axial position, the shifting element 520 can rotate relative to the locking element 540 about the first axis 101. In the present example, when the shifting element 520 is in the second axial position, the shifting element 520 and the locking element 540 no longer form an engagement connection, and the shifting element 520 can rotate relative to the locking element 540 about the first axis 101. The transmission mechanism 500 includes at least a one-stage reduction mechanism. When the shifting element 520 is in the first axial position, the shifting element 520 is fixed by the locking element 540 in the circumferential direction of the first axis 101. At this time, the reduction mechanism rotates according to a preset trajectory, so that the speed output by the motor 400 is reduced by the reduction mechanism and transmitted to the output shaft 200. When the shifting element 520 is in the second axial position, the engagement of the shifting element 520 with the locking element 540 in the circumferential direction of the first axis is released, and the shifting element 520 and the reduction mechanism form a fixed connection in the circumferential direction of the first axis 101. At this time, the shifting element 520 rotates synchronously with the reduction mechanism, and the reduction mechanism only has a transmission function and has no reduction function. In the present example, the transmission mechanism 500 includes a first planet gear assembly 531, a second planet gear assembly 532, and a third planet gear assembly 533 sequentially arranged along the first axis 101, and the shifting element 520 is a ring gear having inner teeth meshing with planet gears. When the shifting element 520 is in the second axial position, the shifting element 520 rotates together with a sun gear and the planet gears of the second planet gear assembly 532 so that the second planet gear assembly 532 has no reduction function.

Specifically, the locking element 540 further includes a supporting portion 542, the locking portions 541 are connected to or integrally formed with the supporting portion 542, the supporting portion 542 is basically ring-shaped, the locking portions 541 are toothed, and the locking portions 541 extend from the surface of the supporting portion 542 along a radial direction 103 of the first axis 101. The locking portions 541 are substantially rod-shaped.

In the present example, the locking portions 541 extend inward from the supporting portion 542 along the radial direction 103 of the first axis 101, and at least part of the supporting portion 542 is sleeved on the outside of the transmission housing 510. The transmission housing 510 is formed with first matching portions 511 engaged with the locking portions 541, and the first matching portions 511 protrude from an end surface of the transmission housing 510 in an axial direction. The shifting element 520 is formed with second matching portions 521 engaged with the locking portions 541, and second matching portions 521 extend along a radial direction of the first axis 101. Specifically, the first matching portions 511 and the second matching portions 521 are both tooth-shaped, the shifting element 520 is accommodated in the transmission housing 510, and the second matching portions 521 are disposed inside the first matching portions 511 along the radial direction. In the present example, the transmission housing 510 and the shifting element 520 are arranged coaxially, and the first matching portions 511 and the second matching portions 521 are arranged in a row along the radial direction of the first axis 101. The locking portions 541 have a plurality of locking surfaces 541*a*, and the locking surfaces 541*a* are parallel to or coincide with the first axis 101. The first matching portions 511 and the second matching portions 521 respectively have a first matching surface 511*a* and a second matching surface 521*a* that are in surface contact with the locking surfaces 541*a*, and the first matching surface 511*a* and the second matching surface 521*a* are parallel or overlapped.

In the present example, the supporting portion 542 of the locking element 540 is a closed ring shape along a circumferential direction, and a plurality of the locking portions 541 are spaced and evenly distributed along the circumferential direction. The first matching portions 511 are also spaced and evenly distributed along the circumferential direction, and the second matching portions 521 are also spaced and evenly distributed along the circumferential direction. The number of the first matching portions 511 is equal to the number of the locking portions 541, and the number of the second matching portions 521 is equal to the number of the locking portions 541. Specifically, there are 12 locking portions 541, first matching portions 511, and second matching portions 521.

According to another example, locking portions, first matching portions and second matching portions may all be distributed at non-spaced manner in a circumferential direction, and the number of the first matching portions and the number of the second matching portions may not be equal to the number of the locking portions.

When the shifting element 520 is in the first axial position, one of the locking surfaces 541*a* at least simultaneously cooperates with the first matching surface 511*a* and the second matching surface 521*a*. In other words, when the shifting element 520 is in the first axial position, one of the locking portions 541 engages with one of the first matching portions 511 and one of the second matching portions 521 at the same time, so that none of the locking element 540 and the shifting element 520 rotates in the circumferential direction relative to the transmission housing 510. In this design, the fixing of the locking element 540 and the fixing of the shifting element 520 are realized only by the locking portions 541, and the structure of the locking portions 541 is simple. At the same time, with this structure, the user can manually remove the locking element 540 in the axial direction, and at the same time unlock the shift element 520, so the maintenance is more convenient.

Figure 17:
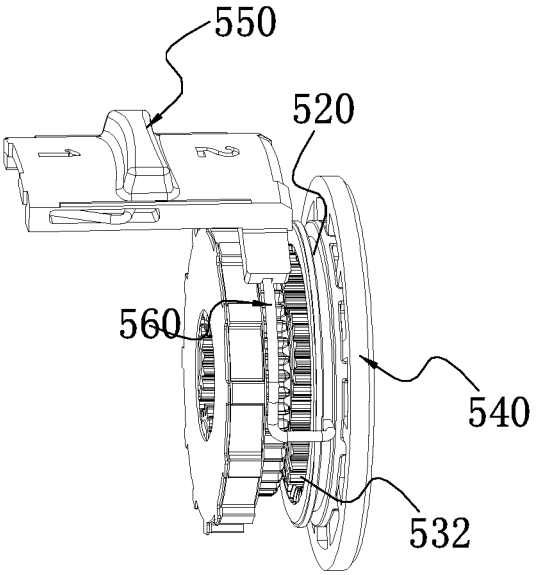
FIG. 17 is a perspective view of the shifting element and a part of the transmission mechanism of the impact drill of FIG. 10 when the shifting element is located at a first axial position.
Figure 18:
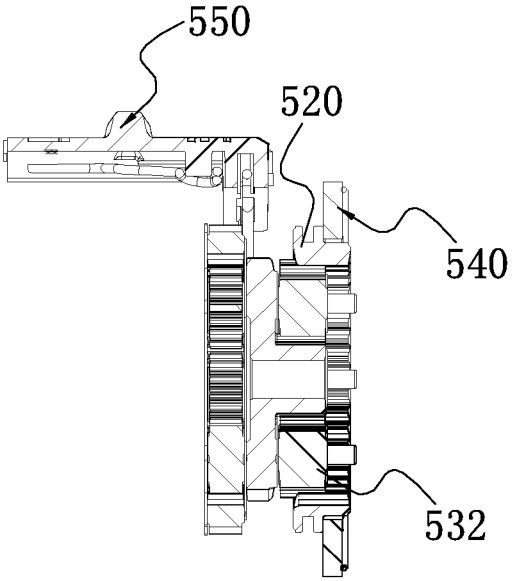
FIG. 18 is a cross-sectional view of the structure shown in FIG. 17.
Figure 19:
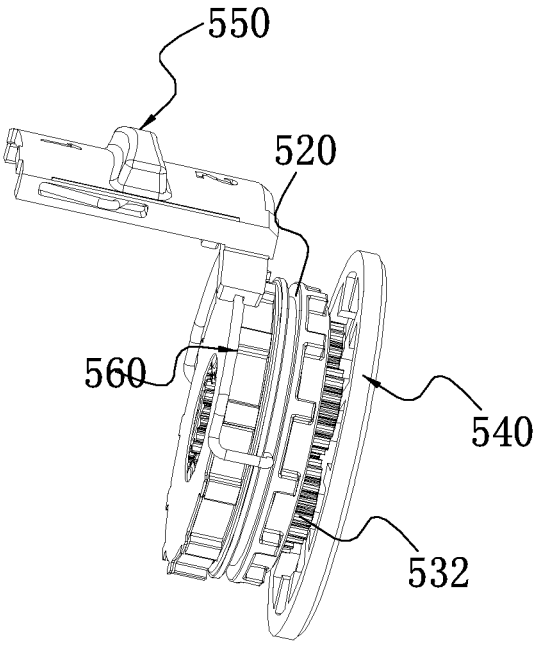
FIG. 19 is a perspective view of the shifting element and the part of the transmission mechanism of the impact drill in FIG. 10 when the shifting element is located at a second axial position.
Figure 20:
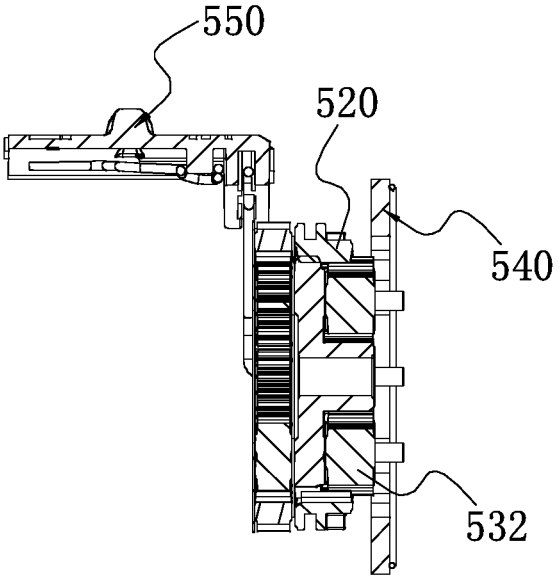
FIG. 20 is a cross-sectional view of the structure shown in FIG. 19.
Figure 21:
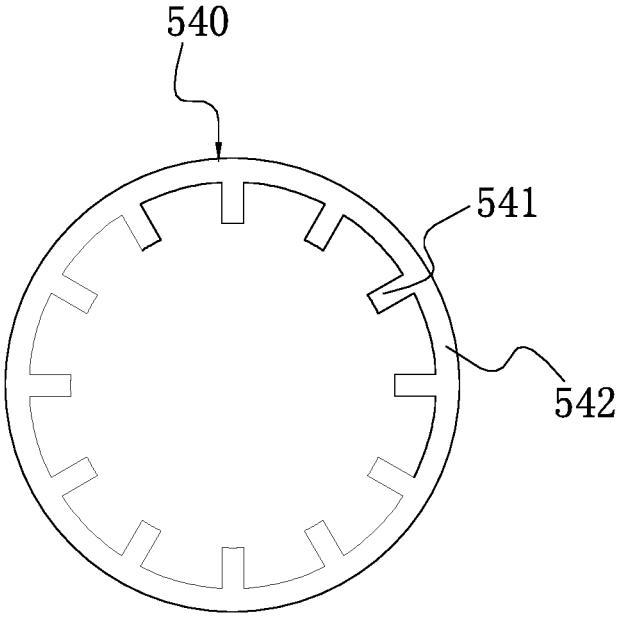
FIG. 21 is a plan view of the locking element of the impact drill of FIG. 16.

As shown in FIGS. 13, 17-20, the impact drill 100 further includes a shifting switch 550. The shifting switch 550 is used for the user to manually adjust a rotation speed of the output shaft 200. The shifting switch 550 is movably connected to the housing 110. In the present example, the shifting switch 550 can at least be switched between a first gear and a second gear relative to the housing 110. When the shifting switch 550 is switched to the first gear, the shifting element 520 moves to the first axial position, and when the shifting switch 550 is switched to the second gear, the shifting element 520 moves to the second axial position. In the present example, the shifting switch 550 is slidably connected to the housing 110. The impact drill 100 further includes a connecting assembly 560 that connects the shifting switch 550 and the shifting element 520. The connecting assembly 560 enables the shifting switch 550 and the shifting element 520 to form a linkage. The shifting element 520 can be driven by the shifting switch 550 to realize a switching between the first axial position and the second axial position. In the present example, the connecting assembly 560 is a swing frame, and it can be understood that the structure of the connecting assembly 560 is not limited to this. The shifting element 520 in FIGS. 17 and 18 is located in the first axial position. At this time, the shifting element 520 is engaged with the locking element 540, and the shifting element 520 cannot be fixed in the circumferential direction relative to the locking element 540. The second planet gear assembly 532 can rotate relative to the shifting element 520 to achieve a deceleration function. The shifting element 520 in FIGS. 19 and 20 is located in the second axial position. At this time, the shifting element 520 is separated from the locking element 540, and the shifting element 520 rotates with the sun gear and the planet gears of the second planet gear assembly 532 together to make the second planet gear assembly 532 have no deceleration effect.

In the present example, the locking element 540 is a stamped part or a powder metallurgy part, or a metal machined part.

Figure 16:
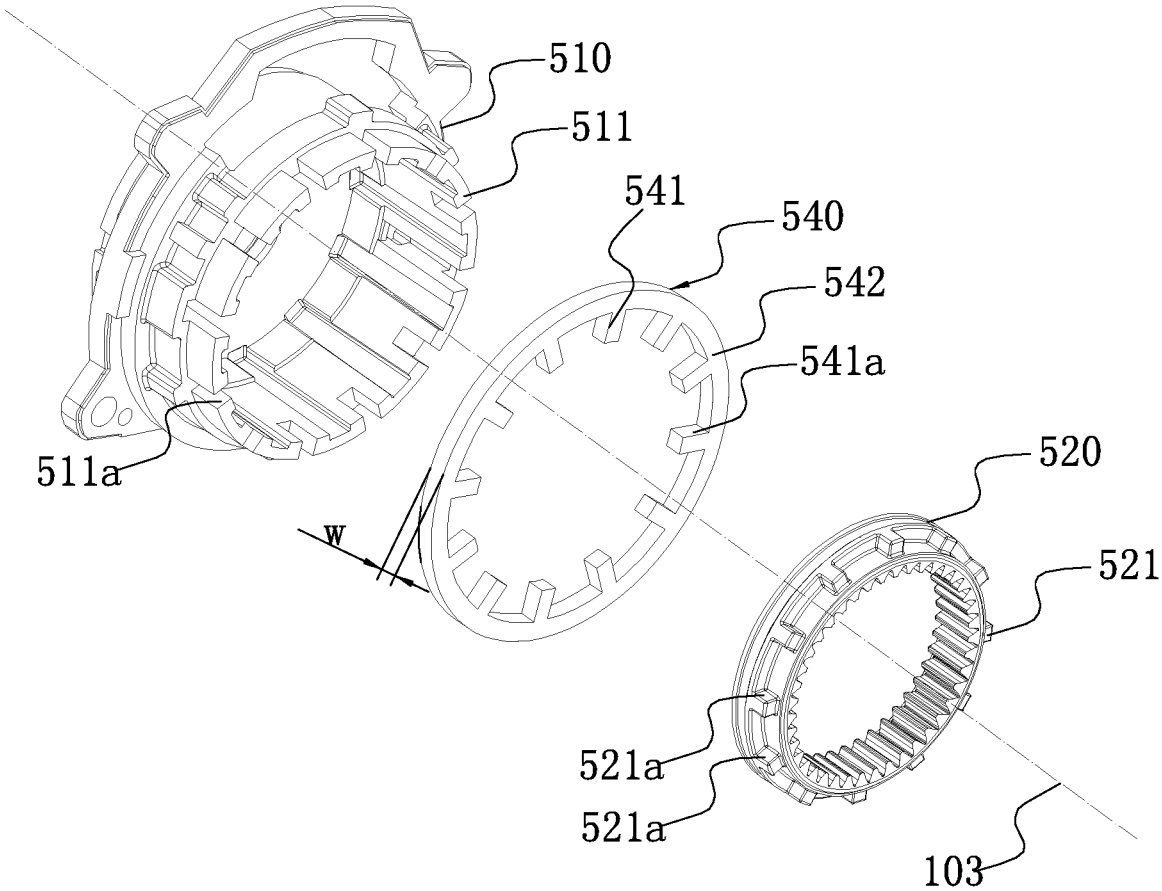
FIG. 16 is an exploded view of the transmission housing, the shifting element and the locking element of FIG. 15.
Figure 22:
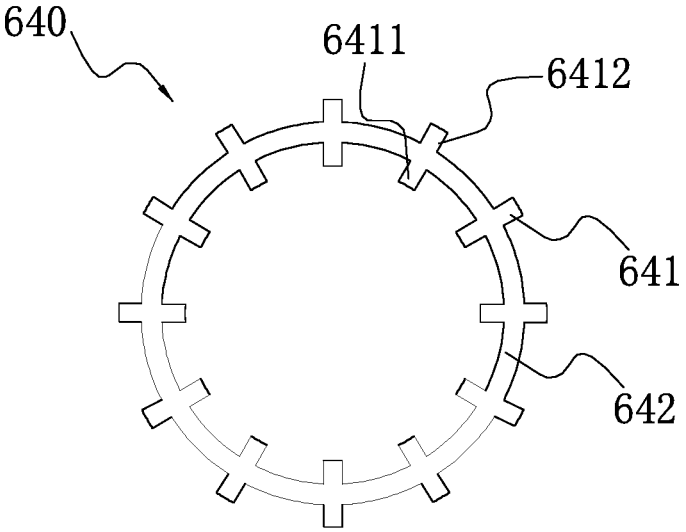
FIG. 22 is a plan view of a locking element of a impact drill according to a second example.

FIG. 22 is a schematic diagram of a locking element 24 of an impact drill according to a second example. Compared with the first example, a difference lies only in the structure of the locking element 24. As shown in FIG. 16, the locking element 540 in the first example includes the supporting portion 542 and the locking portions 541. The supporting portion 542 extends along a ring shape, and the locking portions 541 extend inwardly form the supporting portion 542 along the radial direction 103 of the first axis 101. As shown in FIG. 22, in the second example, the locking element 640 includes a supporting portion 641 and locking portions 641. The supporting portion 641 expands in a ring shape, and the locking portions 641 extend from the supporting portion 641 along a radial direction of a third axis 203. Each of the locking portions 641 includes a first extension portion 6411 and a second extension portion 6412. The first extension portion 6411 extends radially inward, the second extension portion 6412 extends radially outward, the first extension portion 6411 is used to engage with a shifting element, the second extension portion 6412 is used to engage with a transmission housing, and the first extension portion 6411 and the second extension portion 6412 extend substantially along a same straight line.

Figure 23:
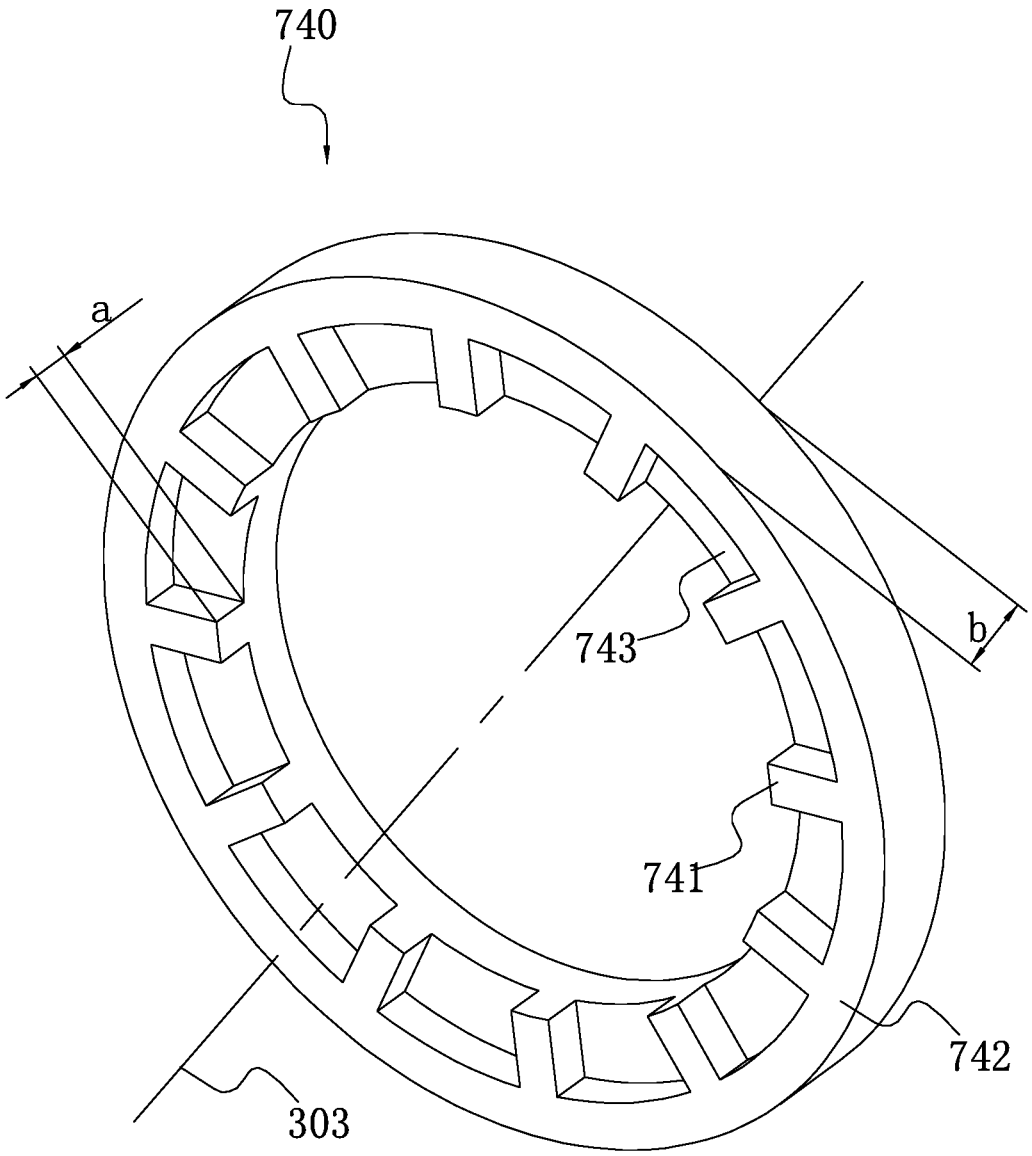
FIG. 23 is a plan view of a locking element of a impact drill according to a third example.

FIG. 23 is a schematic diagram of a locking element 740 of an impact drill according to a third example. Compared with the first example, the difference lies only in the structure of the locking element 740. In the third example, the locking element 740 not only includes a supporting portion 742 and locking portions 741. The locking element 740 also includes a base 743. The base 743 is arranged at one end of the locking element 740 along an axial direction of a third axis 303, and the locking portions 741 are connected or integrated with the base 743. In other words, one end of the locking portions 741 in a radial direction are connected or integrally formed with the supporting portion 742, and one end of the locking portions 741 along the axial direction are connected or integrally formed with the base 743. The base 743 can strengthen the strength of the locking portions 741, so that the locking element 740 has higher reliability. In the third example, since the locking element 740 is provided with the base 743, the thickness a of the locking portions 741 along the axial direction of the third axis 303 is smaller than the thickness b of the locking element 740 along the axial direction of the third axis 303. As shown in FIG. 16, in the first example, since the locking element 540 has no base, the thickness of the locking portions 541 along the axial direction of the first axis 101 is equal to the thickness w of the locking element 540 along the axial direction of the first axis 101.

A fourth example of the present invention is a speed change device, which is used to switch the rotation speed of a output shaft of an impact drill. The speed change device includes a shifting element and a locking element. The shifting element has at least a first axial position and a second axial position relative to a housing of the impact drill, the locking element includes locking portions extending along a radial direction of a rotation axis, and the housing is engaged with the locking portions so that the locking element is fixed in a circumferential direction of the rotation axis relative to the housing. When the shifting element is in the first axial position, the shifting element engages with the locking portions to fix the shifting element relative to the locking element in the circumferential direction of the rotation axis. When the shifting element is in the second axial position, the shifting element can rotate relative to the locking element about the rotation axis. The locking element further includes a supporting portion, the locking portions are connected to or integrally formed with the supporting portion, and the locking portions extend inward from the supporting portion. It should be noted that the housing of the impact drill in this example may be the transmission housing as in the first example, or other housings of the hand-held tool. The structure of the shifting element and the locking element in this example is the same as that of the first example.

Obviously, the foregoing examples are provided merely for the purpose of clearly illustrating the subject impact drill and are not intended to limit the invention claimed. For those of ordinary skill in the art, various obvious changes, readjustments and substitutions fall within the protection scope of the invention claimed. Any modification, equivalent replacement and improvement made within the spirit and principle of the present disclosure shall be included in the protection scope of the claims of the present invention.

What is claimed is:

1. An impact drill, comprising:

an output shaft capable of rotating around a first axis and moving along the first axis;

a housing comprising an accommodating portion for accommodating at least a part of the output shaft;

a first impact block fixedly connected to the output shaft;

a second impact block arranged in the housing;

an elastic member configured to have an elastic force that makes the first impact block and the second impact block separate from each other;

a stopping element sleeved on the output shaft and comprising an annular portion and a plurality of protrusions, a front end of the stopping element abuts a bearing connected to the output shaft for selectively stopping the output shaft from moving backward along the first axis; and a movable element mounted on the housing;

wherein the housing is formed with a through hole for accommodating at least a part of the movable element, the through hole passes through the housing in a first line, the movable element is capable of moving to a first position and a second position along the first line, when the movable element moves to the first position along the first line, the movable element abuts against a rear end of the at least one of the plurality of protrusions of the stopping element to prevent the output shaft from moving backward, and, when the movable element moves to the second position along the first line, the movable element disengages with the stopping element to allow the output shaft to move backward, and wherein the movable element is a pin with a head having an outer diameter larger than the diameter of the through hole to seal the through hole.

2. The impact drill of claim 1, wherein the first line is perpendicular to the first axis.

3. The impact drill of claim 1, wherein the first line extends in a radial direction perpendicular to the first axis.

4. The impact drill of claim 1, wherein the movable element comprises a main body disposed in the through hole and the main body extends along the first line.

5. The impact drill of claim 4, wherein the main body is a cylinder, the through hole is a cylindrical hole, and the diameter of the cylinder is substantially equal to the diameter of the cylindrical hole.

6. The impact drill of claim 4, wherein the movable element further comprises a head portion arranged at one end of the main body, the head portion is disposed outside the accommodating portion, and the main body can be inserted into an inner side of the accommodating portion along the first line.

7. The impact drill of claim 1, wherein the movable element is a pin extending along the first line.

8. The impact drill of claim 7, wherein an area of a cross-section of the movable element in a plane perpendicular to the first line is substantially equal to an area of a cross-section of the through hole in the plane.

9. The impact drill of claim 1, wherein the impact drill further comprises a switching assembly for driving the movable element to move from the second position to the first position.

10. The impact drill of claim 9, wherein the switching assembly is located outside the accommodating portion.

11. The impact drill of claim 10, wherein the through hole is provided on the accommodating portion.

12. The impact drill of claim 1, wherein the impact drill further comprises a spring sleeved on the movable element and the spring is adapted to reserve an elastic force for pushing the movable element to the second position.

13. The impact drill of claim 1, wherein the impact drill further comprises a limiting element fixedly arranged in the housing, the limiting element provided with a sliding groove extending along a direction parallel to the first axis, and the stopping element is provided with a protrusion that cooperates with the sliding groove such that the limiting element limits the rotation of the stopping element about the first axis.

14. The impact drill of claim 13, wherein the stopping element further comprises a protrusion for interacting with the movable element, the stopping element is provided with a stopping element sliding groove for accepting the protrusion, and the protrusion can slide along the stopping element sliding groove.

15. The impact drill of claim 1, wherein the stopping element is arranged in the accommodating portion.

16. The impact drill of claim 1, wherein the first impact block is provided with a first tooth surface and the second impact block faces the first impact block and is provided with a second tooth surface for engaging with the first tooth surface.

17. An impact drill, comprising:

a housing;

an output shaft capable of rotating around a first axis and moving along the first axis;

a first impact block fixedly connected to the output shaft;

a second impact block arranged in the housing;

an elastic member configured to have an elastic force that makes the first impact block and the second impact block separate from each other; and a movable element mounted on the housing;

wherein the housing is formed with a through hole for accommodating at least a part of the movable element, the through hole passes through the housing in a first line, the movable element is capable of moving to a first position and a second position along the first line, when the movable element moves to the first position along the first line, the movable element contact a stopping element sleeved on the output shaft to prevent the output shaft from moving backward, and, when the movable element moves to the second position along the first line, the movable element allows the output shaft to move backward, wherein the movable element is a pin with a head having an outer diameter larger than the diameter of the through hole to seal the through hole, wherein the movable element is proximate a rear end of the stopping element, and the stopping element includes an annular portion and a plurality of protrusions such that the movable element abuts a rear end of the protrusions, and wherein the through hole is located at rear side of the stopping member when the movable element cooperates with stopping element.

18. The impact drill of claim 17, wherein the first line is perpendicular to the first axis.

19. The impact drill of claim 17, wherein the first line extends in a radial direction perpendicular to the first axis.

20. The impact drill of claim 19, wherein the movable element comprises a main body extending along the first line.

* * * * *